United States Patent [19]

Mori et al.

[11] 4,174,196

[45] Nov. 13, 1979

[54] SCREW FLUID MACHINE

[75] Inventors: Hidetomo Mori; Katsumi Matsubara; Haruo Mishina; Akira Arai; Riichi Uchida, all of Ibaraki; Eiji Yokoyama, Kashiwa; Hajime Arai, Ibaraki, all of Japan

[73] Assignee: Hitachi, Ltd., Japan

[21] Appl. No.: 816,185

[22] Filed: Jul. 15, 1977

[30] Foreign Application Priority Data

Jul. 28, 1976 [JP] Japan ..... 51-89117
Oct. 25, 1976 [JP] Japan ..... 51-127205

[51] Int. Cl.[2] ..... F04C 23/00; F04C 29/02; F04C 29/04; F04C 29/06

[52] U.S. Cl. ..... 418/9; 418/85; 418/86; 418/99; 418/181

[58] Field of Search ..... 418/5, 10, 9, 14, 85, 418/83, 86, 89, 99, 181, 201, 270, 47, 199; 417/312

[56] References Cited

U.S. PATENT DOCUMENTS

| | | | |
|---|---|---|---|
| 1,443,764 | 1/1923 | Smith | 418/9 |
| 2,126,279 | 8/1938 | Redfield et al. | 418/85 X |
| 2,755,990 | 7/1956 | Nilsson et al. | 418/201 X |
| 3,134,537 | 5/1964 | Bentele et al. | 418/83 |
| 3,360,193 | 12/1967 | Harris et al. | 417/312 |
| 3,820,923 | 6/1974 | Zweifel | 418/85 X |

FOREIGN PATENT DOCUMENTS

| | | | |
|---|---|---|---|
| 1147443 | 4/1963 | Fed. Rep. of Germany | 418/181 |

*Primary Examiner*—Carlton R. Croyle
*Assistant Examiner*—Leonard E. Smith
*Attorney, Agent, or Firm*—Craig and Antonelli

[57] ABSTRACT

Screw fluid machines are for use as a compressor for generating high pressure gas, a cooling-medium-compressing compressor for use in a refrigerator or an air conditioner. The fluid machine includes a rotor casing, two side-casings, a pair of screw rotors, and accessories such as silencer, a gas cooler, an oil cooler, and an oil tank. The rotor casing includes an outer wall, an inner wall and interconnecting members or ribs which interconnect the outer wall and the inner wall, with a space being provided between the outer wall and the inner wall. This space is partitioned into two or more spaces by means of the aforesaid interconnecting members. A working chamber or space is provided inwardly of the inner wall and has an inlet port and a discharge port. Both side-casings are secured to the opposite end faces of a rotor casing through the medium of flanges and are provided with a passage adapted to bring two or more spaces thus partitioned, into communication with each other. A pair of rotors are housed in meshing relation in a working chamber in the rotor casing. In addition, accessories are housed in spaces thus partitioned.

14 Claims, 21 Drawing Figures

FIG. 4'
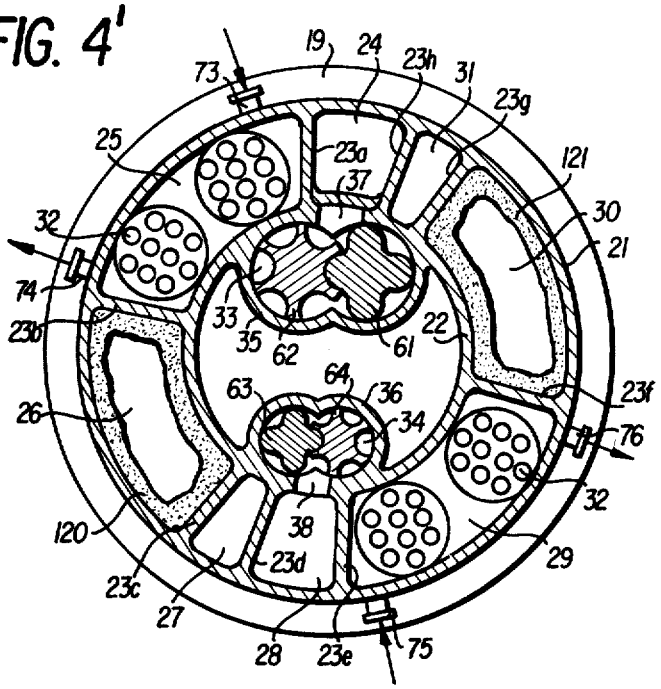
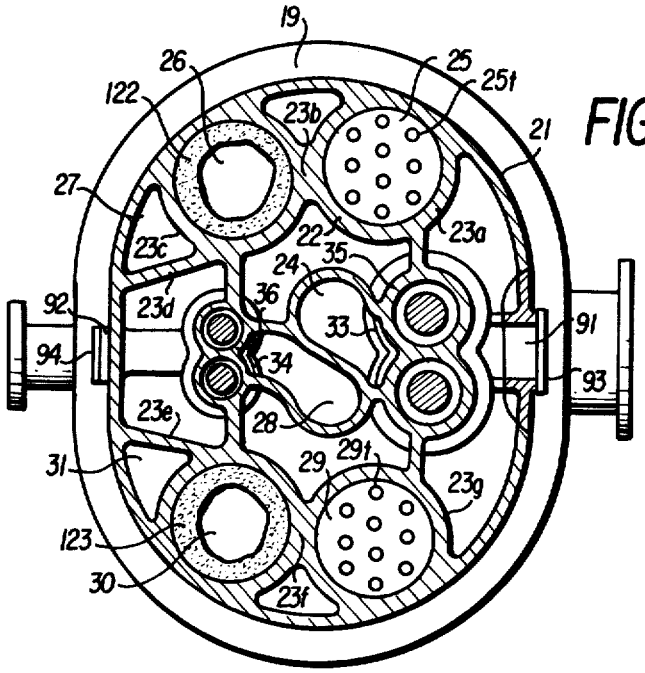
FIG. 14'

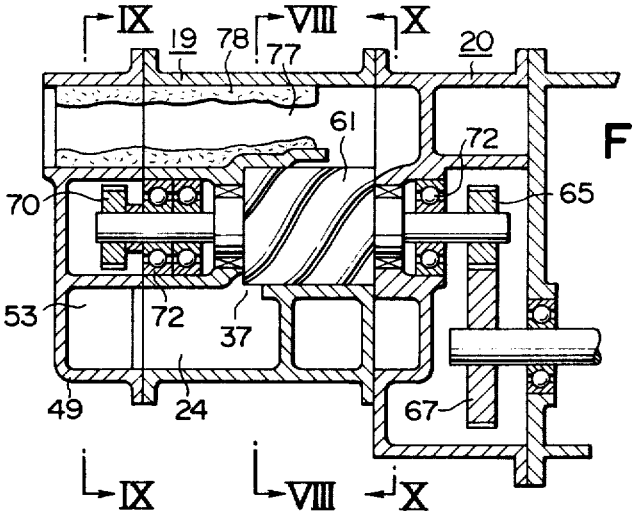
FIG. 7
FIG. 8
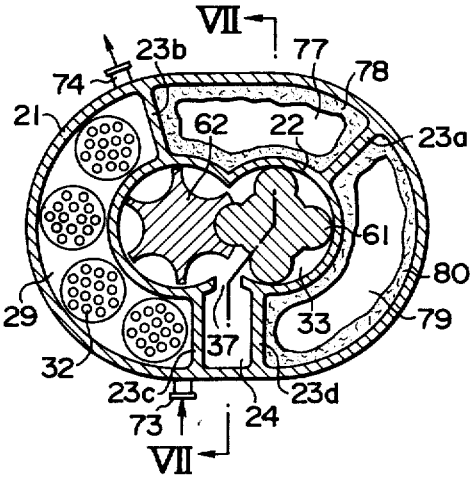
FIG. 9
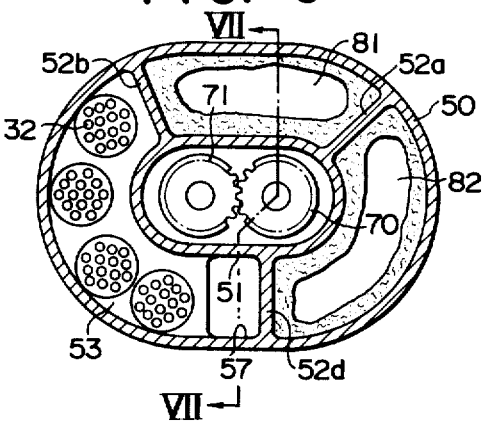
FIG. 10
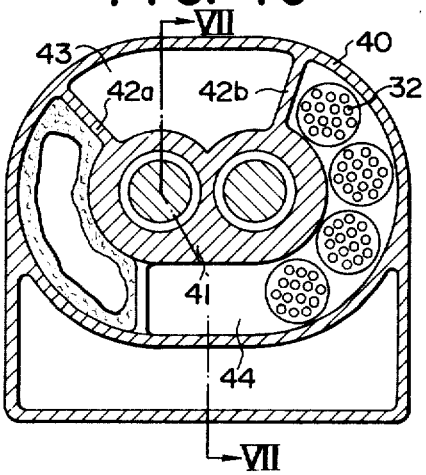

SCREW FLUID MACHINE

BACKGROUND OF THE INVENTION

1. FIELD OF THE INVENTION

This invention relates to a screw fluid machine for use as a compressor generating a high pressure gas or a cooling-medium-compressing compressor used in a refrigerator or an air conditioner.

2. DESCRIPTION OF THE PRIOR ART

FIG. 1 is a plan view, partly in cross-section, of a conventional type screw fluid machine, and FIG. 2 shows the right-hand side view of the machine of FIG. 1. FIG. 1 however shows the fluid machine having a sound-proof cover removed.

A fluid machine as shown in FIGS. 1 and 2 is a compressor adapted to generate a high pressure gas and consists essentially of an electric drive motor 1, speed-up gear unit or speed change gear unit 2, and a compressor 3. The electric drive motor 1 and speed change gear unit 2 are set up on a common base 5. The compressor 3 consists of a low pressure stage compressor **3*l* and a high pressure stage compressor 3*h*, and secured to a casing 6 provided for speed change gear unit 2 through the medium of flanges. The cooler 4 consists of a rear cooler 4*a*, and an intermediate cooler 4, which is placed in a gas flow path communicating the low pressure stage compressor 3*l* with the high pressure stage compressor 3*h*, while the rear cooler 4*a* is positioned in a gas discharge path of the high pressure stage compressor 3*h*. The speed change gear unit 2 includes a rotary shaft 9 which is supported by the casing 6 through the medium of bearings 7, 8. A driving gear 10 is secured to the rotary shaft 9 thereon. Two follower or driven gears 11, 12 mesh with the driving gear 10. The follower gear 11 is secured to a rotor shaft 13 for the low pressure stage compressor 3*l*, while the follower gear 12 is secured to a rotor shaft 14 for the high pressure stage compressor 3*h*, respectively. One end of the rotary shaft 9 projects from the casing 6 in piercing relation, while a coupling 15 is secured to the projecting end of the rotary shaft 9. The rotary shaft 9 is coupled to the electric drive motor 1 by means of the coupling 15. An inlet side silencer 16 is positioned in an inlet path of the low pressure stage compressor 3*l*, while a discharge side silencer 17 is placed in a discharge path of the high pressure stage compressor 3*h***.

With the prior art fluid machine of the arrangement thus described, the low pressure stage compressor **3*l*, high pressure stage compressor 3*h*, and speed change gear unit 2 are integrally provided, although these components are provided separately of an intermediate cooler 4*i*, rear cooler 4*a*, inlet-side silencer 16, discharge-side silencer 17 or accessories for the compressor 3, such as an oil separator, oil cooler and the like (not shown). The aforesaid accessories are selected for a suitable combination according to the specification required. However, these accessories are provided not integrally, so that the arrangement thereof should be determined for each combination of accessories, and in addition, a space required for accessories is increased, thus failing to reduce the size of a fluid machine. Still furthermore, the compressor 3, i.e., a source of noise is exposed, so that sound stemming from the compressor 3** is directly transmitted to the surrounding, thus posing a noise problem.

SUMMARY OF THE INVENTION

It is an object of the present invention to provide a screw fluid machine of a compact size.

It is another object of the present invention to provide a screw fluid machine which is free of a noise problem.

It is a further object of the present invention to provide a fluid machine, in which the arrangement of accessories of several kinds may be changed.

BRIEF DESCRIPTION OF THE DRAWINGS

FIG. 4' is a cross-sectional view of a modified first embodiment of the machine, taken along line IV—IV of FIG. 3;

FIG. 7 is a cross-sectional view of the second embodiment of the machine according to the present invention;

FIG. 8 is a cross-sectional view of the machine, taken along the line VIII—VIII of FIG. 7;

FIG. 9 is a cross-sectional view of the machine, taken along the line IX—IX of FIG. 7;

FIG. 10 is a cross-sectional view of the machine, taken along the line X—X of FIG. 7;

FIG. 14' is a cross-sectional view of a modified fourth embodiment of the machine, taken along line XIV—XIV of FIG. 13;

DESCRIPTION OF THE PREFERRED EMBODIMENTS

Figure 1:
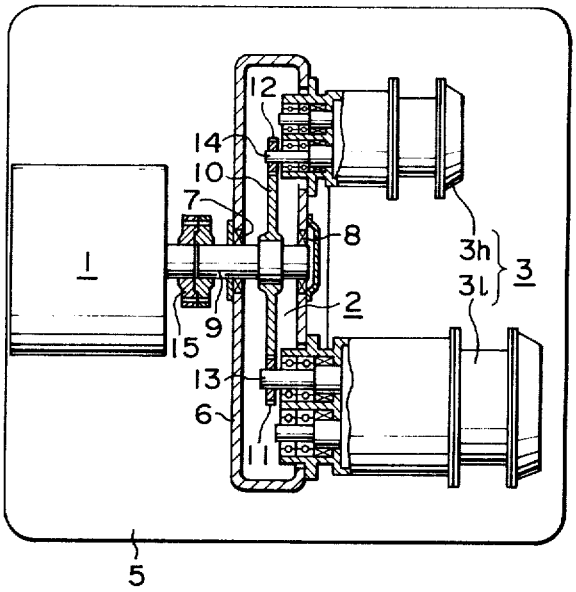
FIG. 1 PRIOR ART
FIG. 1 is a plan view of a prior art screw compressor.
Figure 2:
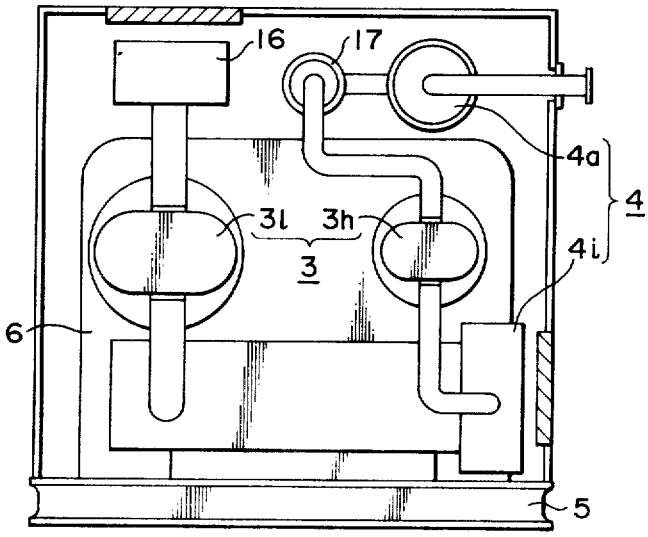
FIG. 2 PRIOR ART
FIG. 2 is a side view of the compressor of FIG. 1.
Figure 3:
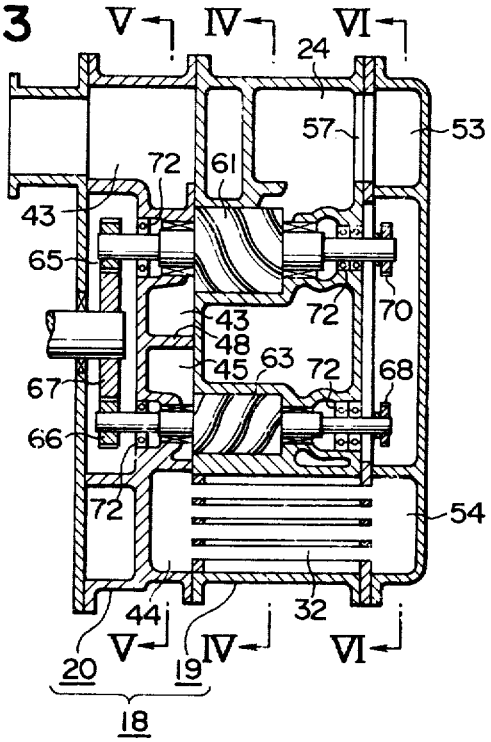
FIG. 3 is a cross-sectional view of the first embodiment of the machine according to the present invention.
Figure 4:
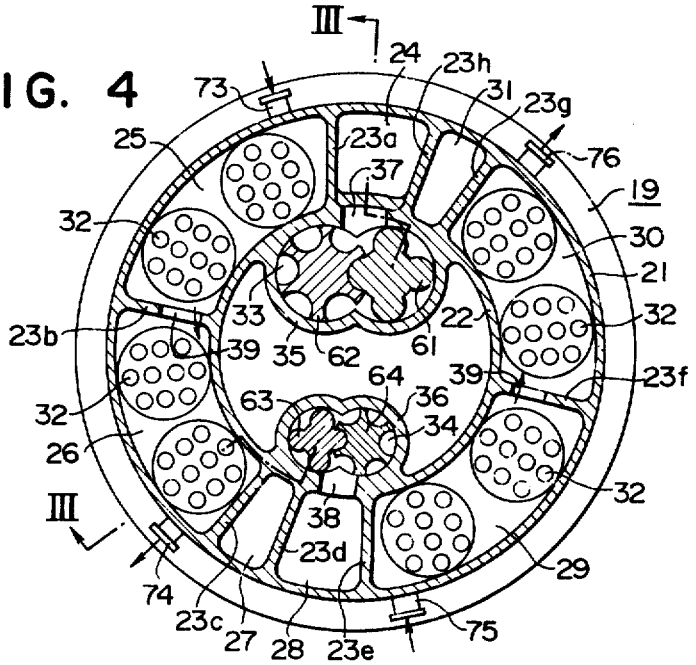
FIG. 4 is a cross-sectional view of the machine, taken along the line IV—IV of FIG. 3.
Figure 5:
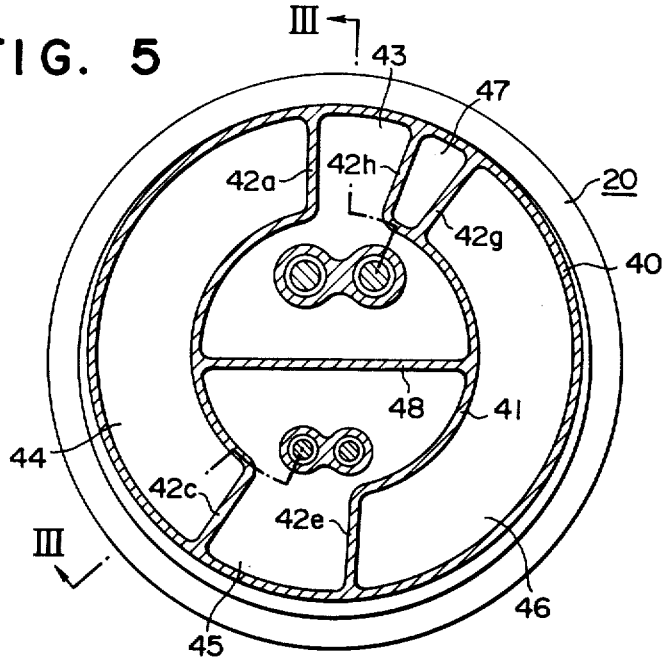
FIG. 5 is a cross-sectional view of the machine, taken along the line V—V of FIG. 3.
Figure 6:
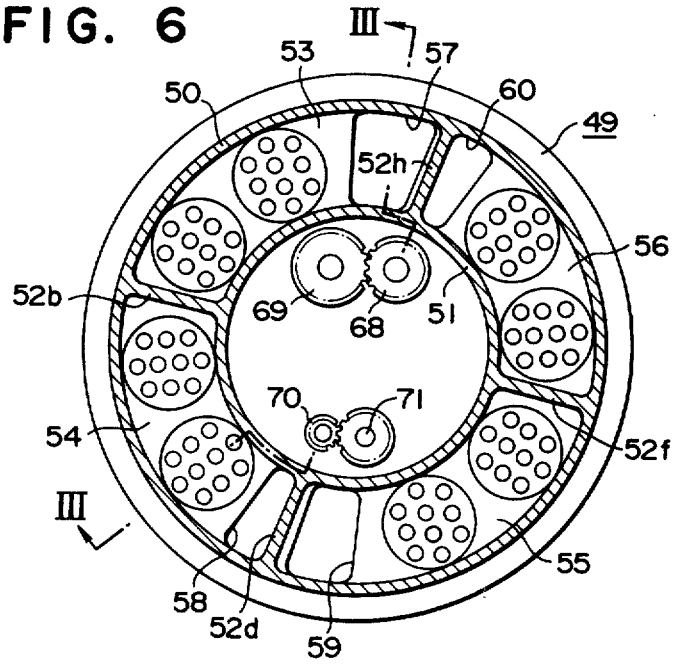
FIG. 6 is a cross-sectional view of the machine, taken along the line VI—VI of FIG. 3.

FIGS. 3, 4, 5 and 6 show the first embodiment of the invention. FIG. 3 is a cross-sectional view taken along the line in parallel with a rotor axis and corresponding to the cross-sectional views taken along the lines III—III of FIGS. 4, 5 and 6. FIG. 4 is a cross-sectional view taken along the line IV—IV of FIG. 3. FIG. 5 is a cross-sectional view taken along the line V—V of FIG. 3. FIG. 6 is a cross-sectional view taken along the line VI—VI of FIG. 3.

A casing 18 consists of a main casing 19, an inlet side-casing 20 and a discharge side casing 49. These casings are fastened together by means of bolts into an integral body.

The main casing 19 consists of an outer wall 21, an inner wall 22 and ribs 23 (23*a* to 23*h*) interconnecting the outer wall 21 and the inner wall 22, with a space left between the outer wall 21 and the inner wall 22. This space is partitioned by the ribs 23 into two or more spaces. The space 24 is used as a low pressure stage discharge passage, spaces 25, 26 are used for an intermediate cooler, a space 27 is used as a return passage, a space 28 is used as a high pressure stage discharge passage, spaces 29, 30 are used for a rear cooler, and a space 31 as a return passage, respectively. Tube nests, in which two or more heat conductive tubes 32 are supported in tubular plates, are placed in the spaces 25, 26, 29, 30 used for an intermediate cooler and a rear cooler. In addition, the main casing 19 includes two working spaces 33, 34 internally thereof, each of which consists of two overlapping cylindrical holes. The working space 33 is used for low pressure stage compressor, and part of a wall of the space 33 is constituted by a wall 35 which is part of the inner wall 22. The working space 34 is used for a high pressure stage compressor, and is defined by a wall 36 in a manner similar to that of the space 33.

The low pressure stage working space 33 is communicated via a discharge port 37 with the low pressure stage discharge passage 24. The high pressure stage working space 34 is communicated via a discharge port 38 with the high pressure stage discharge passage 28.

Holes 39 are defined in a rib 23*b* partitioning the space 25 from the space 26, both of which are used for intermediate coolers, as well as in a rib 23*f* partitioning the space 29 from the space 30, both of which are used for rear coolers. The spaces 25, 26 and spaces 29, 30 are communicated with each other via holes 39, respectively. The inlet side casing 20 includes an outer wall 40 in the position corresponding to that of the outer wall 21 of the main casing 19, an inner wall 41 in the position corresponding to the inner wall 22 of the latter, a partitioning member 42*a* in the position corresponding to the rib 23*a*, a partitioning member 42*c* corresponding to the rib 23*c*, a partitioning member 42*e* corresponding to the rib 23*e*, a partitioning member 42*g* corresponding to the rib 23*g* and a partitioning member 42*h* corresponding to the rib 23*h*, respectively. Thus, a space is partitioned into two or more spaces by the aforesaid members. The space 43 is used as a low pressure stage inlet passage, the space 44 is used as a communicating passage which brings a plurality of heat conductive tubes 32 in the intermediate cooler in communication with each other, the space 45 is used as a high pressure stage inlet passage, the space 46 is used as a communicating passage which brings a plurality of heat conductive tubes 32 in a rear cooler AC in communication with each other, and the space 47 is used as an exhaust passage, respectively. Provided inwardly of the inner wall 41 is a partitioning wall 48 which partitions the low pressure stage inlet passage 43 from the high pressure stage inlet passage 45.

The end face of the main casing 19 on a side opposite to the inlet side casing 20 is coupled to a discharge side casing 49. The discharge side casing 49 includes an outer wall 50 in the position corresponding to the outer wall 21 of the main casing 19 and an inner wall 51 in the position corresponding to the inner wall 22. Partitioning members 52*b*, 52*d*, 52*f*, 52*h* are provided in the positions corresponding to the ribs 23*b*, 23*d*, 23*f*, 23*h*, so that a space defined between the outer wall 50 and the inner wall 51 is partitioned into two or more spaces thereby. A space 53 is used as a communicating passage which brings into communication with each other heat conductive tubes 32 housed in the space 25, of the intermediate cooler IC, a space 54 as a communicating passage which brings into communication with each other the heat conductive tubes 32 housed in the space 26, of the intermediate cooler IC, a space 55 is used as a communicating passage which brings into communication with each other the heat conductive tubes 32 housed in the space 29, of the rear cooler AC, and a space 56 is used as a communicating passage, which brings into communication with each other the heat conductive tubes 32 housed in the space 30, of the rear cooler, respectively. The communicating passage 53 is communicated via a hole 57 with the low pressure stage discharge passage 24, the communicating passage 54 is communicated via a hole 58 with the return passage 27, the communicating passage 55 is communicated via a hole 59 with the high pressure stage discharge passage 28, and the communicating passage 56 is communicated via a hole 60 with the return passage 31. Disposed in the low pressure stage working space 33 in the main casing 19 are a pair of screw rotors 61, 62 adapted to rotate in meshing relation. Likewise, disposed in the high pressure stage working space 34 are a pair of screw rotors 63, 64.

Pinions 65, 66 are secured on the shafts of screw rotors 61, 63, respectively. The both pinions 65, 66 mesh with a driving gear 67 coupled to an electric motor (not shown). Synchronizing gears 68, 69 in meshing relation are secured on the shafts of the screw rotors 61, 62, therebetween, while synchronizing gears 70, 71 in meshing relation are secured to the shafts of screw rotors 63, 64 therebetween.

Bearings 72 are provided at the opposite ends of each of screw rotors 61, 62, 63, 64, respectively, thereby supporting the screw rotors 61, 62, 63, 64, rotatably.

Description will now be given of the operation of this embodiment of the invention.

The driving gear 67 is rotated by means of an electric motor or other driving means. The rotation of the driving gear 67 is transmitted through the medium of the pinion 65 to the screw rotor 61, with its rotational speed increased, while the rotation of the screw rotor 61 is transmitted through the medium of synchronizing gears 68, 69 to the screw rotor 62. As a result, both screw rotors 61, 62 are rotated in meshing relation, so that a gas is introduced through the low pressure stage inlet passage 43, then compressed to an intermediate pressure level, and then discharged from the discharge port 37 into the low pressure stage discharge passage 24. The gas at an intermediate pressure level is delivered in the order of hole 57→ communicating passage 53→ heat conductive tubes 32→ communicating passage 44→ heat conductive tubes 32→ hole 58→ return passage 27, and eventually to the high pressure stage inlet passage 45. The gas is cooled by a cooling liquid outside of the heat conductive tubes 32, during its passing through the heat conductive tubes 32 in the intermediate cooler IC, and hence compression heat is removed.

On the other hand, the rotation of driving gear 67 is transmitted via the pinion 66 to the screw rotor 63, with its rotational speed increased. As a result, gas is introduced from the high pressure stage inlet passage 45, compressed to a desired pressure level, and then discharged from the discharge port 38 into the high pressure stage discharge passage 28. The compressed gas is delivered in the order of hole 59→ communicating passage 55→ heat conductive tubes 32→ communicating passage 46→ heat conductive tubes 32→ communicating passage 56→ hole 60→ return passage 31, and then eventually to the exhaust passage 47, from which gas is delivered to an intended position. The gas discharged through the exhaust passage 47 is cooled by a cooling liquid outside of the heat conductive tubes 32, during its passing through the heat conductive tubes 32 in the rear cooler AC, and hence compression heat is removed. Description will be turned to the flow of a cooling liquid.

Cooling liquid enters through an entrance 73 into the space 25 in the intermediate cooler IC, then through the hole 39 into the space 26, and from there through an exit 74 to the outside. Another flow path of cooling liquid is such that the liquid enters through the entrance 75 into the space 29 in the rear cooler AC, then through the hole 39 into the space 30 and then through the exit 76 to the outside.

In the aforesaid embodiment, a screw fluid machine equipped with a low-pressure-stage, discharge-side silencer and high-pressure-stage, discharge-side silencer in addition to the aforesaid intermediate and rear coolers may be modified, as shown in FIG. 4' such that tube nests provided in the space 26 for the intermediate cooler IC are removed and sound-absorbing material 120 is lined over a wall surface. The hole 39 of FIG. 4 in the rib **23*b* is blocked with a plug; in FIG. 4'. The entrance 73 is positioned so as to communicate with the space; tube nests provided in the space 30 in the rear cooler AC are removed from FIG. 4, and sound-absorbing material 121 is lined over the wall surface. The hole 39 FIG. 4 in the rib 23*f* is blocked with a plug in FIG. 4'. The; and the position of the entrance 75 is changed so as to communicate with the space 29**. In addition, either one of the low-pressure-stage, discharge-side silencer or the high-pressure-stage, discharge-side silencer may be provided as required.

FIGS. 7, 8, 9 and 10 show the second embodiment of the invention. FIG. 7 is a cross-sectional view taken along the line in parallel with a rotor shaft of a compressor, and corresponding to the cross-sectional views taken along the line VII—VII of FIGS. 8, 9 and 10. FIG. 8 is a cross-sectional view taken along the line VIII—VIII of FIG. 7. FIG. 9 is a cross-sectional view taken along the line IX—IX of FIG. 7. FIG. 10 is a cross-sectional view taken along the line X—X of FIG. 7.

In the second embodiment, like parts are designated by like reference numerals in common with those given in the first embodiment shown in FIGS. 3 to 6, and thus description of these parts is omitted.

The main casing 19 consists of an outer wall 21 and an inner wall 22, and ribs 23 (**23*a* to 23*d*) interconnecting the outer wall 21 and the inner wall 22. A space is defined between the outer wall 21 and the inner wall 22. This space is partitioned into two or more spaces by the ribs 23. The space 77 is used for an inlet side silencer, with a sound-absorbing material 78** lined over a wall surface.

The space 29 is used for a rear cooler AC, and tube nest in which a plurality of heat conductive tubes 32 are supported by a tubular plate, are placed therein.

The space 24 is used as a discharge passage. The space 79 is used for a discharge side silencer, with the sound absorbing material 80 lined over a wall surface.

In this embodiment, the inner wall 22 includes a wall defining a working space 33 consisting of two overlapping cylindrical holes. Screw rotors 61, 62 are housed inwardly of the inner wall 22.

The discharge side casing 49 has an outer wall 50 in the position corresponding to the outer wall 21 of the main casing 19, and an inner wall 51 in the position corresponding to the inner wall 22.

The discharge side casing 49 includes partitioning members **52*a*, 52*b*, 52*d* in the positions corresponding to the ribs 23*a*, 23*b*, 23*d* in the main casing 19. The space 81 defined by the partitioning members 52*a*, 52*b* is used for part of the inlet side silencer 77**, with the sound absorbing material being lined over a wall surface.

The space 53 is used as a communicating passage and communicated via a hole 57 with the discharge passage 24. The space 82 is used as part of the discharge side silencer to be described later, and communicated with the discharge side silencer 79, with the sound absorbing material 80 being lined over a wall surface thereof. The inlet side casing 20 includes an outer wall 40 in the position corresponding to the outer wall 21 of the main casing 19, and an inner wall 41 in the position corresponding to the inner wall 22. In addition, the inlet side casing 20 includes partitioning members **42*a*, 42*b* in the positions corresponding to the ribs 23*a*, 23*b* of the main casing 19, so that two spaces are defined by the partitioning members 42*a*, 42*b*. The space 43 is used as an inlet passage and communicated with the inlet side silencer 77. The space 44 brings the heat conductive tubes 32 into communication with the discharge side silencer 79**.

The operation of the second embodiment is the same as that of the first embodiment. The second embodiment permits the provision of a silencer on an inlet side or a discharge side for the first stage.

Figure 11:
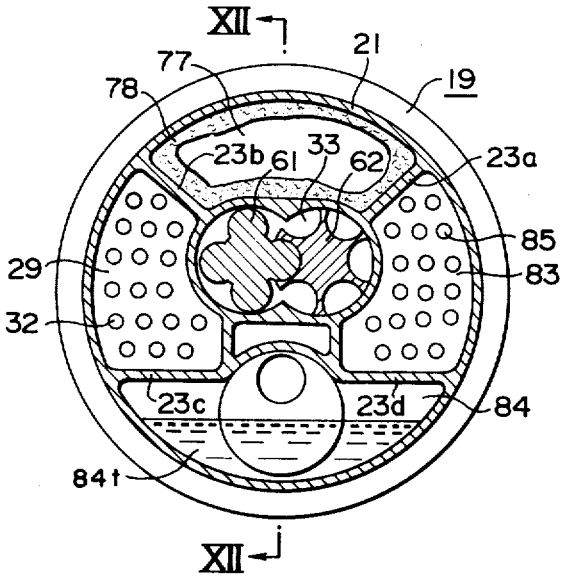
FIG. 11 is a cross-sectional view of the third embodiment of the machine according to the present invention.
Figure 12:
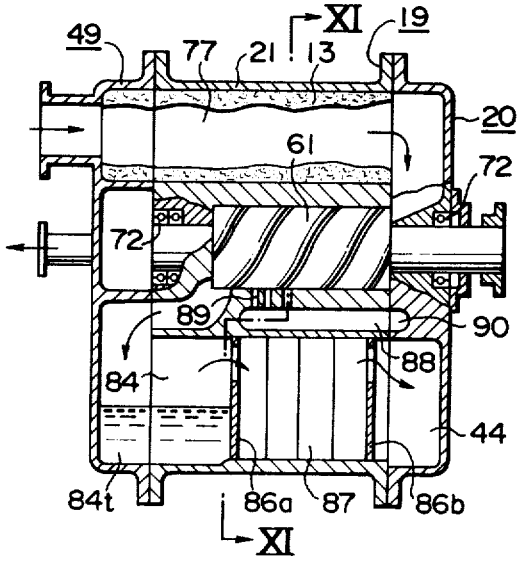
FIG. 12 is a cross-sectional view of the machine, taken along the line XII—XII of FIG. 11.

FIGS. 11 and 12 show the third embodiment of the invention, which is used as an oil injection type screw compressor.

FIG. 11 is a cross-sectional view taken along the line XI—XI of FIG. 12. FIG. 12 is a cross-sectional view taken along the line XII—XII of FIG. 11.

With the third embodiment, in place of the discharge side silencer 82 as used in the second embodiment (FIGS. 7 to 10), the space therefore is used for an oil cooler 83, and a space 84 is defined between the oil cooler 83 and the rear cooler 29, and is used for an oil separator.

Heat conductive tubes 85 are placed in a space used for the oil cooler 83. Separator element 87 encompassed with a frame plates **86*a*, 86*b* is placed in a space used for an oil separator. An oil jacket 88 is placed among the oil separator 84, working space 33, rear cooler 29 and oil cooler 83. The oil jacket 88 is communicated via a small hole 89 with the working space 33, and then via communicating passage 90 in the inlet casing 20 with the interior of heat conductive tubes 85** at the sidewise end of the inlet side casing.

The sidewise end of the discharge-side casing for heat conductive tubes 85 is communicated via a pipe (not shown) with an oil sump **84*t* in the oil separator 84**. Meanwhile, an oil pump may be provided on the aforesaid pipe.

In this embodiment, synchronizing gears 70, 71 are eliminated, while rotation is transmitted to the follower screw rotors by means of the screw rotors 61, 62 meshed with each other. The operation of the third embodiment will be described hereunder.

The screw rotor 61 is driven by means of an electric motor or other driving means, so that screw rotors 61, 62 are rotated. Accordingly, gas is introduced via the inlet side silencer 77 into the working space 33 and then compressed.

On the other hand, due to a pressure difference between the oil separator 84 and the working space 33 or an oil pump, oil in the oil sump 84*t* in the oil separator 84 flows in the order of heat conductive tubes 85 in the oil cooler 83→ communicating passage 90→ oil jacket 88, and then through the small hole 89 into the working space 33. The oil is mixed on the compression stroke with gas introduced in the working space 33, and discharged into the oil separator 84 along with compressed gas. The compressed gas containing oil is then introduced into the oil separator 84, where oil is removed and a clean gas is obtained. The compressed gas is delivered via the communicating passage 44, then through the heat conductive tubes 32 in the rear cooler 29 for cooling, and then delivered to an intended position.

Figure 13:
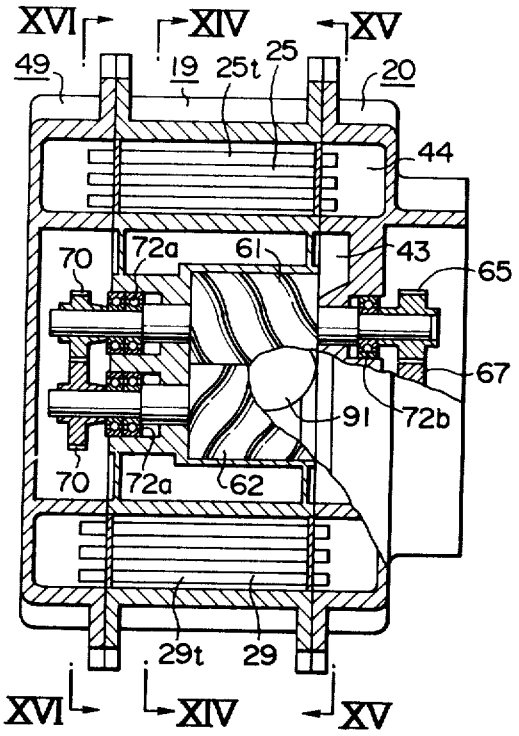
FIG. 13 is a cross-sectional view of the fourth embodiment of the machine according to the present invention.
Figure 14:
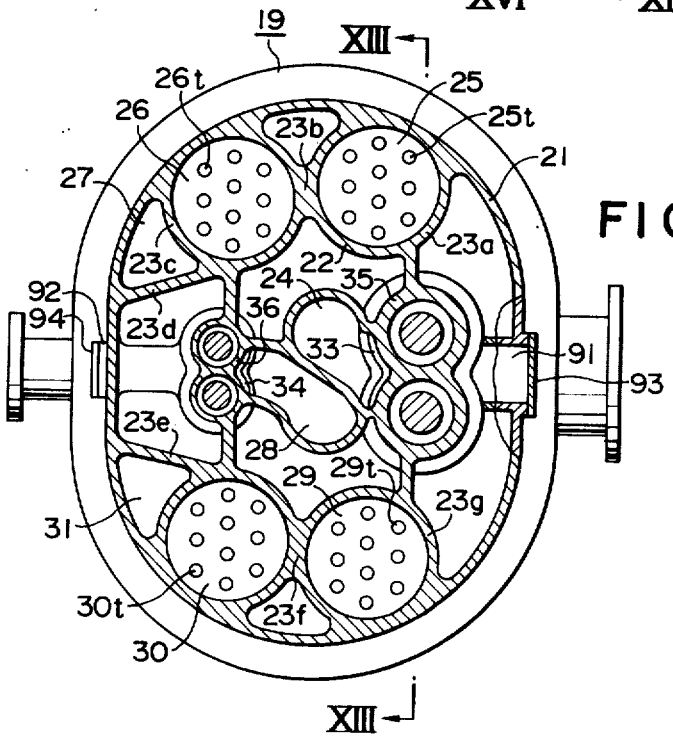
FIG. 14 is a cross-sectional view of the machine, taken along the line XIV—XIV of FIG. 13.
Figure 15:
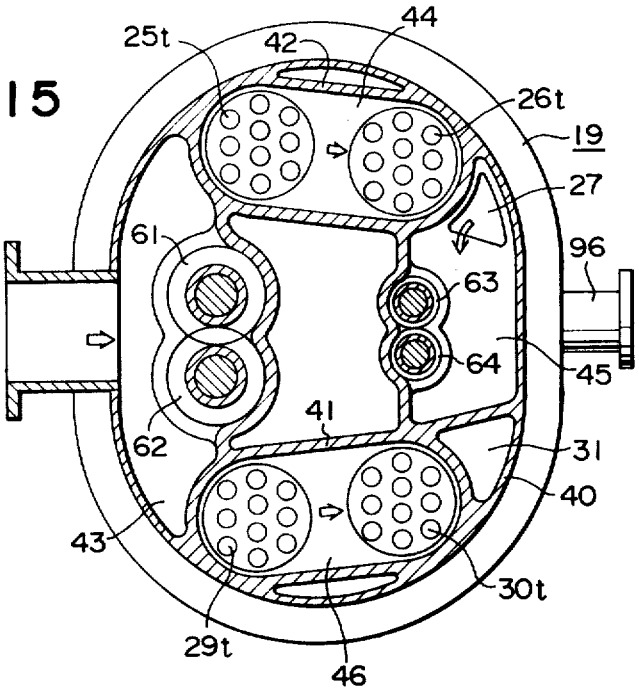
FIG. 15 is a cross-sectional view of the machine, taken along the line XV—XV of FIG. 13.
Figure 16:
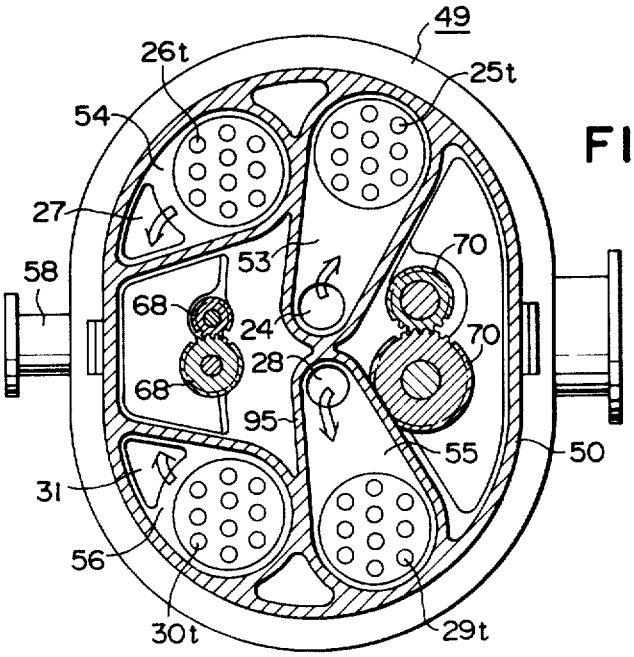
FIG. 16 is a cross-sectional view of the machine, taken along the line XVI—XVI of FIG. 13.

FIGS. 13, 14, 15 and 16 show the fourth embodiment of the invention. FIG. 13 is a cross-sectional view taken along a plane passing through a rotor shaft, and corresponds to a cross-sectional view taken along the line XIII—XIII of FIG. 14. FIG. 14 is a cross-sectional view taken along the line XIV—XIV of FIG. 13. FIG. 15 is a cross-sectional view taken along the line XV—XV of FIG. 13, and FIG. 16 is a cross-sectional view taken along the line XVI—XVI of FIG. 13.

A major difference between the fourth embodiment and the first, second and third embodiments is that a low pressure discharge passage and/or a high pressure stage discharge passage is placed in the central portion of the casing. This difference is also noted in the fifth and sixth embodiments to be described later.

A casing 18 consists of a main casing 19, an inlet side casing 20 and a discharge side casing 49, and these casings are fastened together into an integral body by means of bolts. The main casing 19 includes an inner wall 22 which is spaced a given distance from the outer wall 21 inwardly thereof, with two or more ribs 23 (23*a* to 23*g*) placed between the outer wall 21 and the inner wall 22, the aforesaid ribs interconnecting the both walls 21, 22 and partitioning the space between the outer and inner walls 21, 22 into two or more spaces. A working space consisting of two overlapping cylindrical holes is defined inwardly of the inner wall 22. The working space 33 is used for a low pressure stage compressor, and part of the space 33 is defined by a wall 35 which forms part of the inner wall 22. The other working space 34 is used for a high pressure stage, and part of the working space 34 is defined by a wall 36 which forms part of the inner wall 22. A low pressure stage discharge passage 24 is provided in the low pressure stage working space 33, while a high pressure stage discharge passage 28 is provided in high pressure stage working space 34 in continuous relation to the passage 24. The discharge passages 24, 28 are provided inwardly of the inner wall 22. Two or more spaces are provided between the outer wall 21 and the inner wall 22. In this respect, heat conductive tubes 25*t*, 26*t*, 29*t*, 30*t* are placed in the spaces 25, 26, 29, 30, while the spaces 25, 26 are used for intermediate cooler IC adapted to cool compressed gas flowing from the low pressure stage to the high pressure stage. The spaces 29, 30 are used for rear coolers adapted to cool compressed gas discharged from the high pressure stage. The space 27 is used as a return passage adapted to introduce a compressed gas from the space 26 in the intermediate cooler IC into the inlet passage for the high pressure stage working space 34. In addition, the space 31 is used as a passage adapted to introduce a compressed gas from the space 30 for the rear cooler AC to an exit. The provision of the both passages 27, 31 is not essential, but may be eliminated depending on the relationship between an exhaust port of the space 26 for the intermediate cooler IC and an entrance of the low pressure stage inlet passage, and the positional relationship between an exit of the space for the rear cooler AC and an exhaust port therefrom. Clearance adjusting holes 91, 92 are provided in piercing relation through the outer wall 21 and inner wall 22 in communication with a low pressure stage working space 33, and high pressure stage working space 34. Both clearance adjusting holes 91, 92 are used as access holes for adjusting clearances between a male rotor and a female rotor with respect to the forward surface and rearward surface of a rotor tooth beforehand, when timing gears to be described later are fitted on the male rotor shaft and on the female rotor shaft. Thus, the holes 91, 92 are not necessary normally, and hence are blocked with blind flanges 93, 94. A male rotor 61 and a female rotor 62 in meshing relation are housed in the aforesaid low pressure stage working space 33. Bearings 72*a*, 72*b* are provided for the shafts of rotors 61, 62. A discharge side of a rotor is supported by the main casing 19 through the medium of bearing 72, and an inlet side of a rotor is supported by the inlet side casing 20 through the medium of bearing 72*b*. A pair of timing gears 70 are fitted on the shafts of male rotor 61 and female rotor 62. The arrangement of the rotors, bearings and timing gears for the high pressure stage are the same as those in the preceding embodiment and thus designated by like reference numerals, with description being omitted. In addition a driving gear 65 is fitted on the shaft of the male rotor 61 for transmitting a rotor driving force. Although not shown, a driving gear is provided for the high pressure stage in a like manner. Provided in the inlet side casing 20 are a low pressure stage inlet passage 43, a communicating passage 44 adapted to bring the tube group 25*t* into communication with tube group 26*t* in the intermediate cooler IC, a high pressure stage inlet passage 45, and a communicating passage 46 bringing a tube group 29*t* into communication with a tube group 30*t* in the rear cooler AC. These passages are partitioned by means of the outer wall 40, inner wall 41, and partitioning members 42. Provided in the discharge side casing 49 are a communicating passage 53 bringing the low pressure discharge passage into communication with a tube group 25*t* in the intermediate cooler IC, a communicating passage 54 bringing a tube group 26*t* in the intermediate cooler IC into communication with a return passage 27, a communicating passage 55 bringing the high pressure stage discharge passage 28 into communication with the heat conductive tube group 29*t*, and a communicating passage bringing heat conductive tube group 30*t* in the rear cooler AC into communication with the return passage 31. These passages are partitioned by means of the outer wall 50 and partition wall 95.

Description will be given on the operation of this embodiment. Male rotors 61, 63 are driven through the medium of a large gear 67 and driving gears 65, 66, by means of a drive means (not shown) such as a motor, engine or the like, and then rotation of the male rotors 61, 63 is transmitted through the medium of timing gears 70, 68 to the female rotors 62, 64, thereby rotating a pair of rotors comprised of male rotor 61, and female rotor 62, and another pair of rotors comprised of male rotor 63 and female rotor 64 in meshing relation, respectively. Due to the rotation of rotors 61, 62, air or other gas (referred to simply as a gas, hereinafter) is admitted in the working space 33, then compressed to an intermediate pressure level by means of the rotors 61, 62, and then discharged into the discharge passage 24. The compressed gas at an intermediate pressure level thus discharged is delivered in the order of communicating passage 53→ heat conductive tube group 25*t* in the intermediate cooler IC→ communicating passage 44 heat conductive tube group 26*t* in the intermediate cooler IC. The gas is cooled during its passing through the heat conductive tube groups 25*t*, 26*t* with a cooling liquid flowing externally thereof. The cooled compressed gas at an intermediate pressure level is then delivered along a path of a communicating passage 54→ return passage 27→ inlet passage 45, and then into the working space 26. The gas is further compressed to a desired pressure level by means of the rotors 63, 64 in the working space 34 and then discharged into the discharge passage 28. The compressed gas thus discharged flows along a path of communicating passage 55→ heat conductive group 29*t* in the rear cooler AC→ communicating passage 46→ heat conductive group 30*t* in the rear cooler AC. The gas is cooled during its passing through the heat conductive tube groups 29*t*, 30*t* with a cooling liquid flowing externally thereof. The compressed gas thus cooled and having a given pressure level is then fed via a return passage 31 and an exhaust passage 96 to a desired position.

Description has been had for the embodiment having intermediate coolers IC and rear coolers AC. Alternatively, the heat conductive tube groups 26*t*, 30*t* may be removed and instead sound-absorbing material may be lined over the inner wall surfaces of the spaces 26, 30, thereby providing a compressor having a discharge side silencer in addition to intermediate and rear coolers.

In addition, a compressor equipped with a front cooler, and an inlet side silencer may be provided by modifying the positions of the inlet side casing 20, a discharge side casing 49, partitioning member 42, and partition wall 95, or the arrangement of respective spaces in the main casing 19.

Figure 17:
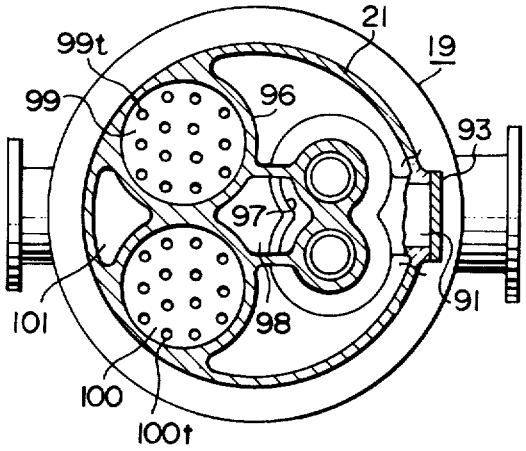
FIG. 17 is a cross-sectional view of a main casing in the fifth embodiment of the machine according to the present invention.

FIG. 17 shows the fifth embodiment of the invention, i.e., a transverse cross-sectional view of the main casing 19.

The interior of the outer wall 21 is partitioned by partition wall 96 into a working passage 97, discharge passage 98, spaces 99, 100 for rear cooler AC, and an exhaust passage 101. The discharge passage 98 is positioned in the central portion of outer wall 21. Male, female rotors housed in the working space 97, timing gears attached to respective rotors, and driving gears are the same as those in the preceding embodiment. Placed in the spaces 99, 100 in the rear cooler AC are heat conductive tube groups 99*t*, 100*t*. Although not shown, a communicating passage brings the tube group 99*t* in communication with a tube group 100*t* in the rear cooler AC, a communicating passage brings the discharge passage 98 into communication with the tube group 99*t* in the rear cooler AC, and a communicating passage brings the tube group 100*t* in the rear cooler AC into communication with the exhaust passage 101.

The operation of this embodiment is substantially the same as that of the preceding embodiment, which has been described up to the intermediate cooler IC (description after gas has been introduced into the high pressure stage working space 34), and thus description is omitted. Meanwhile, in FIG. 17, a clearance measuring hole and a blind flange closing the aforesaid hole are shown by like reference numerals 91, 93.

Figure 18:
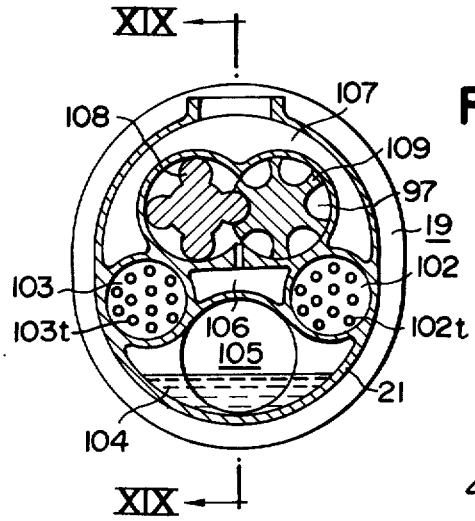
FIG. 18 is a cross-sectional view of the sixth embodiment of the machine according to the present invention.
Figure 19:
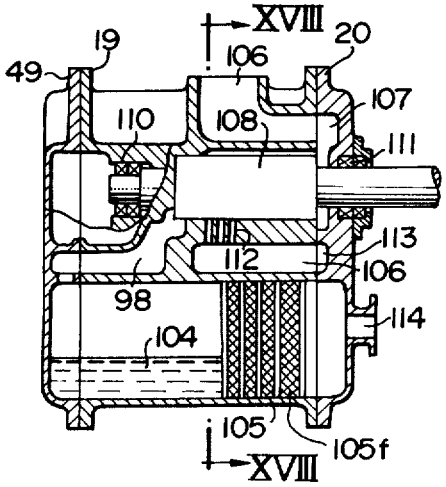
FIG. 19 is a cross-sectional view of the machine, taken along the line XIX—XIX of FIG. 18.

FIGS. 18 and 19 show the sixth embodiment of the oil injection type screw compressor. FIG. 18 is a cross-sectional view taken along the line XVIII—XVIII of FIG. 19. FIG. 19 is a cross-sectional view taken along the line XIX—XIX of FIG. 18.

A casing 18 consists of a main casing 19, an inlet side casing 20 and a discharge side casing 49, and these casings are fastened into an integral body by means of bolts. Provided internally of the outer wall 21 are working space 97 consisting of two overlapping cylindrical holes, two spaces 102, 103 for oil coolers, a separator 105, a discharge passage 98, an oil jacket 106, and an inlet passage 107. These spaces are partitioned by partition walls. Housed in the working space 97 are a pair of a male rotor 108 and a female rotor 109 rotating in meshing relation. Shafts of the both rotors 108, 109 are supported by the main casing 19 through the medium of bearings 110, and by the inlet side casing 20 through the medium of bearings 111, respectively. The oil jacket 106 is communicated with the working space 97 via an oil injection port 112. Tube groups 102*t*, 103*t* are provided in spaces 102, 103 for oil coolers. A filter element 105*f* is disposed in the oil separator 105.

Provided in the inlet side casing 20 are an inlet passage 107, a communicating passage bringing the oil jacket 106 into communication with the tube groups 102*t*, 103*t* in oil coolers, and a discharge pipe 114.

Although not shown, there is provided in the discharge side casing 49 a passage for introducing oil from a gear pump (not shown) into the tube groups 102*t*, 103*t* in the oil cooler.

Description will be turned to the operation of the sixth embodiment. The male rotor 108 is driven by means of a drive means (not shown), thereby directly driving the female rotor 109 in meshing relation to the male rotor 108. On the other hand, a gear pump (not shown) is driven at the same time. (A gear pump is often attached to the shaft end of the rotor, so that additional means for driving the gear pump is not often necessary.) Due to the rotation of male and female rotors 108, 109 in meshing relation, air (or gas) is introduced from the inlet passage 107, compressed to a desired pressure level, and discharged into the discharge passage 98. On the other hand, oil fed from the oil tank 104 by means of a gear pump is fed to the tube groups 102*t*, 103*t* in oil coolers, and the oil is cooled during its passing through the tube groups 102*t*, 103*t* with a cooling liquid flowing externally of the groups 102*t*, 103*t*. The oil thus cooled is fed under pressure via a communicating passage 113 into the oil jacket 106. Oil is then injected through an injection port 112 into the position of working space 97 on a compression stroke, for cooling compressed gas, for lubrication, for sealing action between mutual rotors and action between rotors and casings, followed by discharge into the discharge passage 98 along with the compressed gas. The oil and compressed gas then enter from the discharge passage 98 into the oil tank 104, wherein oil droplets of a relatively large size may be removed. The compressed gas containing oil droplets of a relatively small size enter the oil separator 105, where a majority of oil droplets are removed by the filter element 105f and delivered through a discharge passage 114 to an intended position.

While description has been given of the embodiment with an oil cooler, part of the oil coolers may be used as a cooler for cooling a compressed gas.

In the first to sixth embodiments, a compressed gas flows through heat conductive tubes, while a cooling liquid flows externally of the heat conductive tubes. However, this arrangement may be inverted.

In addition, in case a high pressure gas is used, the condition of gas varies depending on requirements or usage. Accordingly, the same accessories as those used in the preceding embodiments should not necessarily be used. This invention therefore includes such accessories within its scope, even if the types of accessories vary according to their requirements.

As is apparent from the foregoing, the casings accommodating a compressor, silencers, coolers, oil separators, and oil tanks are used or constructed commonly, with flow paths of gas running through the casing. As a result, the number of parts constituting a fluid machine may be reduced 20 to 30%, and man hours required for machining or assembly may be reduced 30 to 40%, as compared with those of the prior art. In addition, the size of the fluid machine may be reduced.

Furthermore, coolers, silencers, oil separators, oil tanks and the like are so arranged as to encompass working spaces of a compressor, and little or no joint is positioned in the gas passages, while the discharge passage is positioned inwardly of an inner wall or in the central portion of the casing, so that noise from a screw compressor will be transmitted to the outside at a minimized noise level. The test results reveal that the noise level of a compressor in a discharge passage is the highest. Accordingly, the provision of the discharge passage inwardly or in the central portion of the casing is effective in lowering the noise level, thus presenting a reduction of 10 dB, as compared with the noise level of a prior art screw fluid machine.

What is claimed is:

1. A screw fluid machine, comprising:

a main casing including an outer tubular wall, an inner tubular wall, a plurality of rib members interconnecting said outer wall and said inner wall and extending from one end to the other end of said inner and outer walls to define between said inner and outer walls a plurality of spaces linearly extending from one end to the other end of said inner and outer walls, and at least one working space located inside said inner wall and having an inlet port and a discharge port, said working space having two cylindrical bores overlapped with one another;

side casings respectively coupled to the end faces of said main casing, each of said side casings having at least one passage therein communicating at least two of said plurality of spaces in said main casing with each other;

at least one pair of screw rotors housed in said working space; and at least two accessories for the screw fluid machine housed in said plurality of spaces in said main casing.

2. A screw fluid machine as set forth in claim 1, wherein said inner and outer tubular walls and said rib members are formed integrally.

3. A fluid machine as set forth in claim 1 wherein said machine is of an oil injection type, and wherein said pair of screw rotors has a male rotor and a female rotor in mesh therewith so that the rotation of the male rotor is directly transmitted to the female rotor due to their meshing relation, with oil being fed into said working space accommodating said pair of screw rotors therein.

4. A screw fluid machine as set forth in claim 3, wherein said accessories include an inlet-side silencer placed in a flow path of a gas being drawn into said working space and lowering the level of noise produced in said working space, an oil tank for storing a cooling lubricating oil, an oil separator for separating oil droplets from a gas discharged from said working space, and an oil cooler for cooling the lubricating oil fed from said oil tank into said working space.

5. A fluid machine as set forth in claim 1, wherein the discharge port of said working space is positioned inwardly of said inner wall of said main casing.

6. A screw fluid machine as set forth in claim 5, wherein said machine is of an oil injection type, and wherein said pair of screw rotors has a male rotor and a female rotor in mesh therewith so that the rotation of the male rotor is directly transmitted to the female rotor due to their meshing relation, with oil being fed into said working space accommodating said pair of screw rotors therein.

7. A fluid machine as set forth in claim 6, wherein a single working space for accommodating said pair of screw rotors is provided, and wherein said accessories include an oil tank for storing therein cooling lubricating oil, an oil separator for removing oil droplets from a gas discharged from said working space, and an oil cooler for cooling the lubricating oil being fed from said oil tank to said working space.

8. A screw fluid machine as set forth in claim 5, wherein said machine is of a dry type, and timing gears are provided between the shafts of said pair of screw rotors, and wherein no oil is fed to the working space accommodating said pair of screw rotors.

9. A screw fluid machine as set forth in claim 8, wherein two working spaces are provided, a pair of screw rotors are housed in each of said two working spaces, one of said two working spaces being a low pressure stage working space and the other of said two working spaces being a high pressure stage working space, and wherein said accessories include an intermediate cooler for cooling gas discharged from said low pressure stage working space and flowing into said high pressure stage working space, and a rear cooler for cooling gas discharged from said high pressure stage working space.

10. A screw fluid machine as set forth in claim 8, wherein two working spaces are provided, a pair of screw rotors are housed in each of said working spaces, one of said two working spaces being a low pressure stage working space and the other of said two working spaces being a high pressure stage working space, and wherein said accessories include an intermediate cooler for cooling gas discharged from said low pressure stage working space and flowing into said high pressure stage working space; a discharge-side silencer comprising a low pressure stage discharge-side silencer for lowering the level of noise produced from said low pressure stage working space, as well as noise stemming from the flowing gas, and a high pressure stage discharge-side silencer for lowering the level of noise produced in said high pressure working space, as well as noise stemming from the flowing gas; and a rear cooler for cooling gas discharged from said high pressure stage working space.

11. A fluid machine as set forth in claim 1, wherein said machine is of a dry type, timing gears are mounted between shafts of said pair of screw rotors, and wherein no oil is fed into said working space in which said pair of screw rotors are housed.

12. A screw fluid machine as set forth in claim 11, wherein at least two working spaces are provided, a pair of screw rotors are housed in each of said two working spaces, one of said two working spaces being a low pressure stage working space and the other of said two working spaces being a high pressure stage working space, and wherein said accessories include an intermediate cooler for cooling gas discharged from said low pressure stage working space and flowing into said high pressure stage working space, and a rear cooler for cooling gas discharged from said high pressure stage working space.

13. A screw fluid machine as set forth in claim 11, wherein at least two working spaces are provided, a pair of screw rotors are housed in each of said two working spaces, one of said two working spaces being a low pressure stage working space and the other of said two working spaces being a high pressure stage working space, and wherein said accessories include: an intermediate cooler for cooling gas discharged from said low pressure stage working space and flowing into said high pressure stage working space; a discharge-side silencer comprising a low pressure stage discharge-side silencer for lowering the noise level of noise produced in said low pressure stage working space as well as noise stemming from the flowing gas, and a high pressure stage discharge-side silencer for lowering noise produced in said high pressure stage working space as well as noise stemming from flowing gas; and a rear cooler for cooling gas discharged from said high pressure stage working space.

14. A screw fluid machine as set forth in claim 11, wherein a single working space is provided for accommodating said pair of screw rotors, and wherein said accessories include an inlet-side silencer placed in a flow path of a gas being drawn into said working space and lowering the level of noise produced in said working space, a rear cooler for cooling the discharged gas, and a discharge-side silencer for lowering the level of noise from said working space and from the flowing gas.

* * * * *